US005399098A

United States Patent [19]

Marshall et al.

[11] Patent Number: 5,399,098

[45] Date of Patent: Mar. 21, 1995

[54] ELECTRICAL CONNECTOR AND TERMINAL THEREFOR FOR MATING WITH A BLADE CONTACT

[75] Inventors: Robert C. Marshall, St. Petersburg; Frank Pansari, Jr., Clearwater, both of Fla.

[73] Assignee: Molex Incorporated, Lisle, Ill.

[21] Appl. No.: 145,439

[22] Filed: Oct. 29, 1993

[51] Int. Cl.[6] ..... H01R 13/115

[52] U.S. Cl. ..... 439/398; 439/845; 439/848

[58] Field of Search ..... 439/397, 399, 409, 398, 439/419, 406, 438, 439, 443, 845, 848, 850, 855, 881

[56] References Cited

U.S. PATENT DOCUMENTS

| | | | |
|---|---|---|---|
| 4,124,265 | 11/1978 | Turk . | |
| 4,317,608 | 3/1982 | Dechelette . | |
| 4,527,852 | 7/1985 | Dechelette . | |
| 4,553,808 | 11/1985 | Weidler et al. . | |
| 4,943,248 | 7/1990 | Colleran et al. | 439/849 |
| 5,290,176 | 3/1994 | Soes et al. | 439/398 |

FOREIGN PATENT DOCUMENTS

| | | | |
|---|---|---|---|
| 1137079 | 5/1957 | France | 439/848 |

*Primary Examiner*—P. Austin Bradley
*Assistant Examiner*—Jeanne M. Elpel
*Attorney, Agent, or Firm*—Stacey E. Caldwell

[57] ABSTRACT

An electrical connector assembly for making a tap connection between an insulated wire and a blade contact. The connector assembly includes an integrally formed housing which mounts a generally U-shaped terminal therein. The terminal includes an IDT portion and a blade-receiving portion, and the U-shape is defined by a pair of generally parallel leg portions joined by a bight portion. The leg portions define a longitudinal terminal axis generally centrally therebetween. The bight portion includes a blade-receiving slot extending into the leg portions and defining a bifurcated contact formation for receiving a blade contact with a locking recess along a centerline thereof. The bight portion is indented on one side of the terminal axis to define an offset portion inwardly of one of the leg portions. The blade-receiving slot and bifurcated contact formation extend into the offset portion. At least one locking projection is formed on the terminal at a portion of the offset portion along the longitudinal axis thereof and extends into the blade-receiving slot for lockingly engaging the locking recess of the blade contact.

13 Claims, 5 Drawing Sheets

ELECTRICAL CONNECTOR AND TERMINAL THEREFOR FOR MATING WITH A BLADE CONTACT

FIELD OF THE INVENTION

This invention generally relates to the art of electrical connectors and, particularly, to a stamped and formed electrical connector and terminal therefor having a wire-receiving portion at one end and a blade-receiving portion at the other end.

BACKGROUND OF THE INVENTION

Many electrical contacts or terminals have been designed for receiving or mating with a male tab or blade contact. Such terminals often are used in tap connectors for making a T-connection to an insulated electrical wire. In such connectors, one end of the terminal includes an insulation displacement, wire-receiving portion, and the opposite end of the terminal includes a mating or blade-receiving portion. Design considerations for these terminals must take into account the differing requirements for both types of connections. Factors which affect the design of the insulation displacement end of the terminal include providing sufficient resistance to wire pull-out, and providing sufficient integrity in the material thickness to displace the insulation without cutting the conductors and without allowing the insulation displacing slots to open. Factors which affect the design of the blade-receiving end of the terminal include selecting a material thickness which does not take a set and which carries maximum current. General design considerations, such as minimizing material waste and simplifying the design and manufacture of the terminals, also are important. Because of the number of factors to be considered, most tap connectors often use relatively complex stamped and formed terminals that include formed blade-receiving slots which typically utilize a relatively large amount of material and are more complicated and difficult to maintain in terms of tolerances than stamped slots.

One type of stamped and formed terminal for connecting an insulated wire to a blade contact and which utilizes a stamped blade-receiving slot is disclosed in U.S. Pat. No. 4,527,852, assigned to the assignee of the subject invention. The terminal is generally U-shaped and includes a pair of leg portions joined by a bight portion. The leg portions define a longitudinal terminal axis generally centrally therebetween. Free ends of the leg portions are provided with insulation displacement slots for electrically connecting the terminal to the insulated wire without stripping or crimping the wire. The bight portion of the terminal includes a blade-receiving slot extending into the leg portions and defining a bifurcated contact formation for receiving the blade contact.

However, one of the problems with the U-shaped terminal described is that it does not provide a simple means for locking to a blade contact when in mated condition. Blade contacts often have standard dimensional features including locking means formed on the blade contact itself. One type of locking means is provided in the form of a recess or detent in one or both sides of the blade contact generally along a centerline thereof. Another type of locking means is provided in the form of an aperture extending through the blade contact. Such a feature allows the blade contact to positively lock to a mating terminal. This locking feature provides high reliability between the terminals and assures the continued connection thereof particularly in high vibration applications involving motors or constant movement. In order to lock the blade contact to a mating terminal, locking projections must be provided on the terminal for protruding into the locking recess(es) or aperture of the blade contact. Heretofore, it has not been possible to provide generally U-shaped terminals with adequate blade-locking means and to still maintain a reliable electrical connection thereto.

In particular, if a locking projection was to be provided in the blade-receiving slot of one of the leg portions of the U-shaped terminal described above, the blade terminal would not be centered within the terminal and therefore may not engage both leg portions of the terminal, thus reducing the contact surfaces between the terminals and minimizing the current-carrying capability of the mated conductors. If the locking projection was provided in the blade-receiving slot at the bight portion of the terminal, along the longitudinal terminal axis, the insertion depth of the blade contact into the terminal may not be sufficient and, again, the current-carrying capacity may be compromised. Furthermore, providing the locking projection directly at the tip or bight portion of the terminal prevents the use or provision of a lead-in mouth for facilitating mating of the terminal and blade contact, which is very advantageous in most applications.

The present invention is directed to solving these problems by providing a unique configuration of a generally U-shaped terminal for receiving a blade contact, which includes a locking feature for the contact, while maximizing the current-carrying capacity of the terminal.

SUMMARY OF THE INVENTION

An object, therefore, of the invention is to provide a new and improved tap connector assembly including a generally U-shaped terminal for mating with a blade contact which has a generally centrally located locking recess or aperture therein.

In the exemplary embodiment of the invention, the connector assembly includes a one-piece housing of dielectric material which accepts a generally U-shaped terminal for electrically connecting an insulated electrical wire to a blade contact. The generally U-shaped terminal is stamped and formed of sheet metal material and includes an IDT portion for receiving the insulated wire and a blade-receiving portion for receiving the blade contact. The U-shape of the terminal is defined by a pair of leg portions joined by a bight portion. The leg portions define a longitudinal terminal axis generally centrally therebetween. The leg portions have free ends defining the IDT portion of the terminal and include generally parallel insulation displacement slots for electrically connecting the terminal to the insulated wire without stripping or crimping. The bight portion includes a stamped slot extending into the leg portions and defining a bifurcated contact formation for receiving and electrically connecting to the blade contact. The slot exhibits a slight taper along the leg portions toward the bight portion which allows the interface between the terminal and the blade contact to extend along substantially the entire slot, thus maximizing the current-carrying capacity of the terminal.

The invention contemplates that the bight portion of the U-shaped terminal be indented on one side thereof to define a portion offset inwardly from one of the leg portions. The slot and bifurcated contact formation extend into the offset portion. A locking projection is formed on a portion of the slot within the offset portion for lockingly engaging the locking recess or aperture of the blade contact, while still maintaining surface-to-surface contact between the blade contact and the terminal.

As disclosed herein, a locking projection is provided on a segment of the offset portion on each of two sides of the slot for engagement in the locking recesses or aperture of the blade contact. The locking projections are located generally along the central terminal axis. The bight portion defines an apex of the terminal on a side of the terminal axis opposite the offset portion. An area of the slot proximate the apex is enlarged to provide a lead-in mouth for facilitating insertion of the blade contact thereinto.

Lastly, in the illustrated embodiment of the invention, the two parallel insulation displacement slots on the free ends of the leg portions of the terminal extend generally perpendicular to the terminal axis, and provide redundant electrical contact between the insulated electrical wire and the terminal, as well as increased resistance to wire pull-out, without necessitating wire-stripping or secondary crimping tools.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
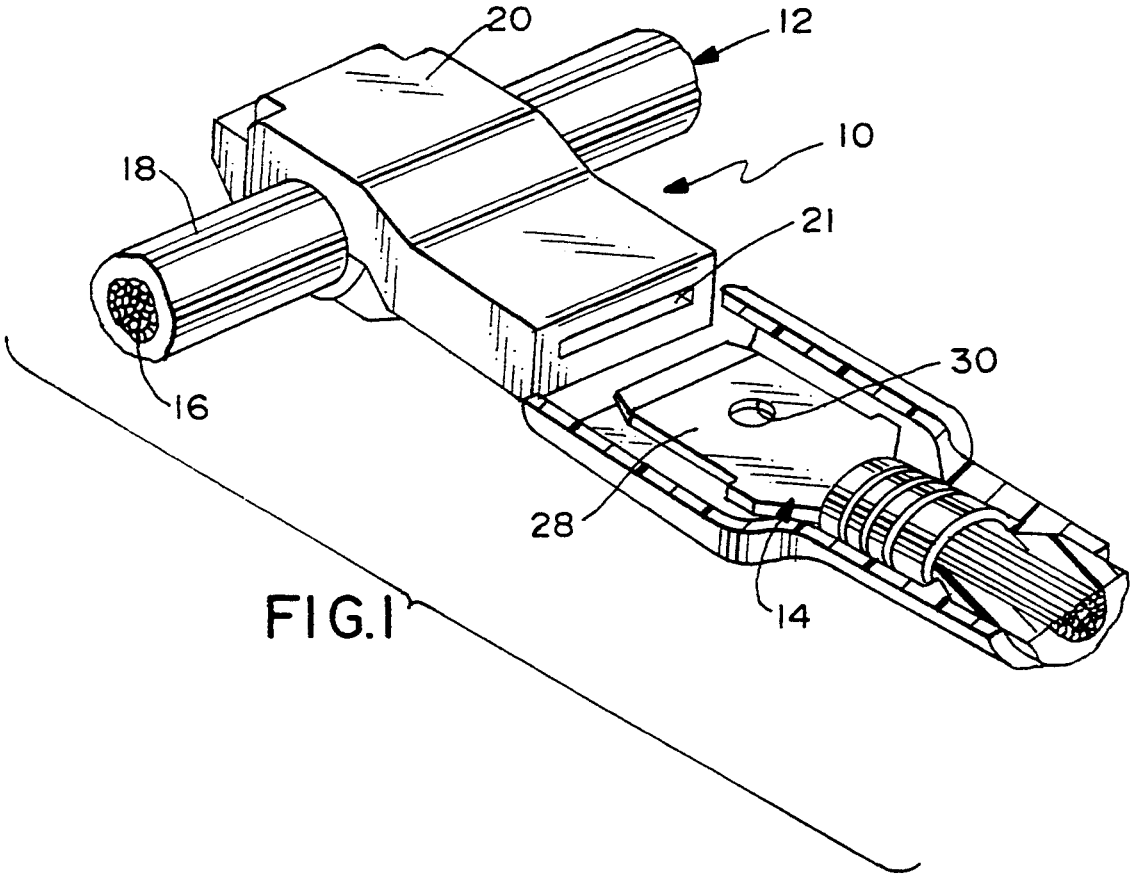
FIG. 1 is a perspective view of an electrical connector assembly embodying the concepts of the invention, along with a mating connector shown partially cutaway to illustrate the blade contact, for mating with the connector assembly.
Figure 3:
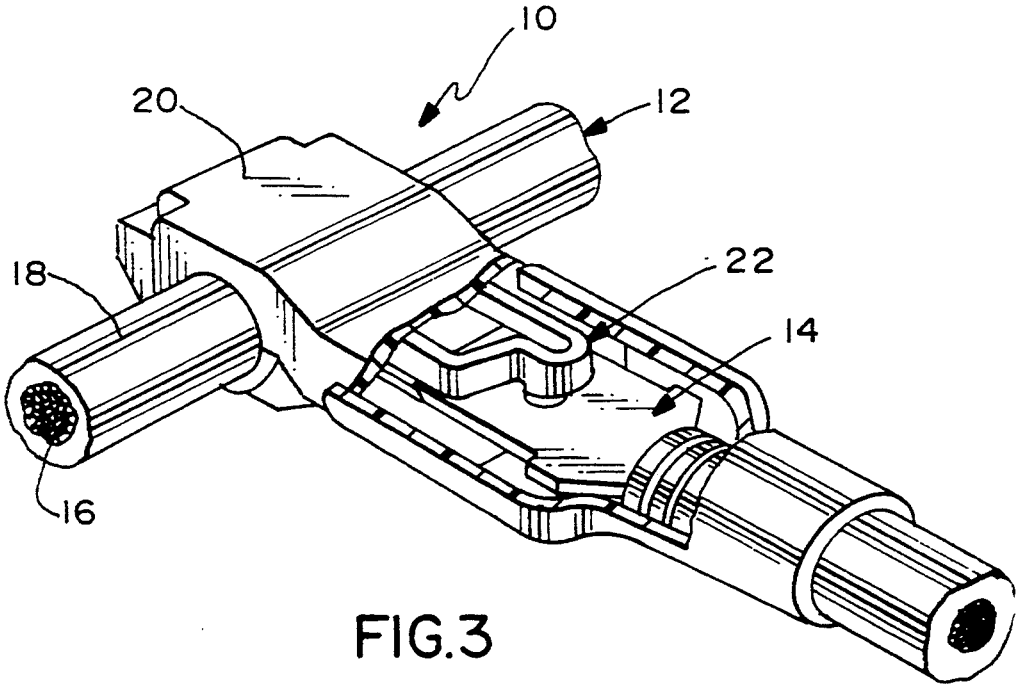
FIG. 3 is a perspective view of the connector assembly and mating connector of FIGS. 1 and 2 shown partially cut-away to shown the blade-receiving terminal in mating engagement with the blade contact and an insulated wire.
Figure 2:
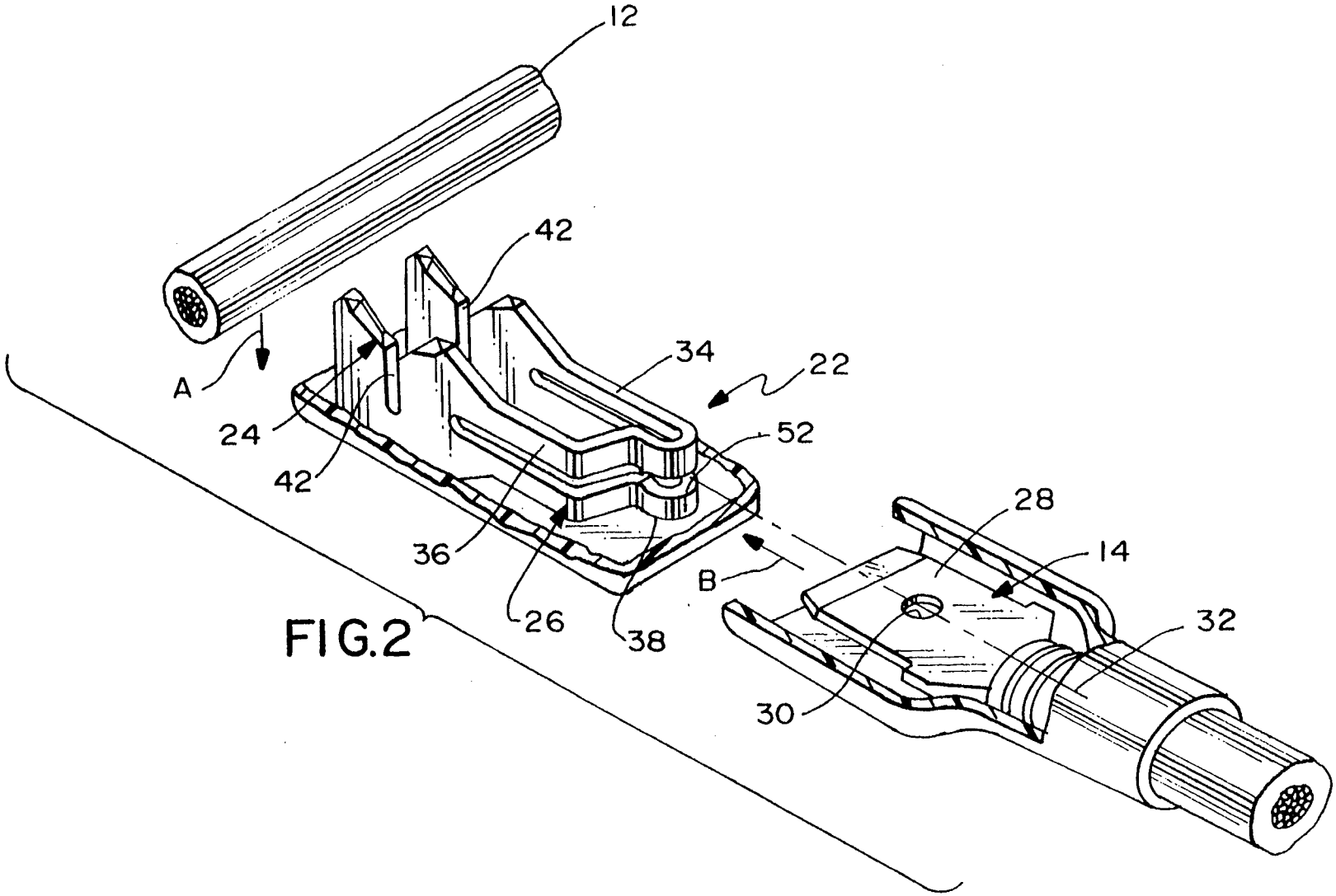
FIG. 2 is an exploded perspective view of the connector assembly and mating connector of FIG. 1 with the connector assembly partially cut-away to show a blade-receiving terminal mounted therein.

Referring to the drawings in greater detail, and first to FIGS. 1–3, the invention is embodied in a connector assembly, generally designated 10, for making an electrical connection between an insulated electrical wire 12 and a blade contact, generally designated 14. Insulated electrical wire 12 includes a center conductor 16 surrounded by a cladding of insulation 18. Connector assembly 10 includes a housing 20 unitarily molded of dielectric material which mounts a blade-receiving terminal 22, and which is provided with a slot 21 for receiving blade contact 14 therethrough. In the preferred embodiment of the connector assembly, the unitarily molded housing folds along a hinge (not shown) proximate slot 21 and closes by way of a latch (not shown) or other integrally formed locking means on a portion of the connector housing opposite the slot 21. Blade-receiving terminal 22 includes an IDT portion or wire-receiving end, generally designated 24, for receiving the electrical wire generally in the direction of arrows "A", and a blade-receiving end, generally designated 26, for receiving the blade contact 14 in the direction of arrow "B", as described in greater detail hereinafter.

Blade contact 14 has a blade portion 28 having parallel planar sides which include a locking detent or aperture 30 generally along a centerline 32 of the contact. The locking recess 30 may be provided on one or both sides of the contact, or, often, a hole simply is stamped entirely through the contact, whereby the hole provides detents on both sides of the blade contact. The blade contact is fairly conventional and, in fact, may comply with a standard or specified design. These blade contacts, with the locking detents, are often used in high vibration applications to provide a reliable, continuous connection between the blade contact and the mating terminal. Such applications include marine, automobile, RV, bus, truck and trailer applications.

Figure 4A:
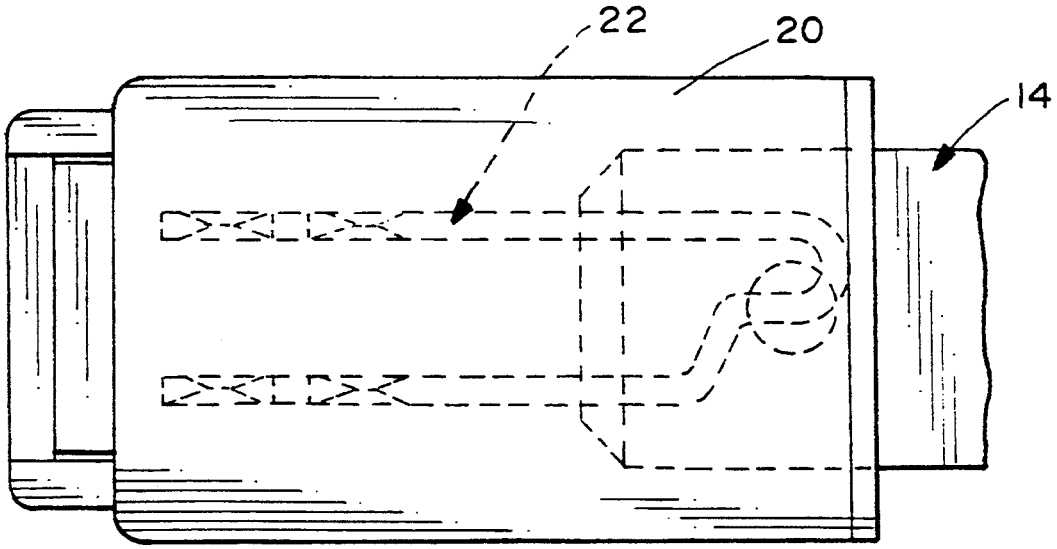
FIG. 4A is a top plan view of the connector assembly and mating connector of FIG. 3 with the blade-receiving terminal shown in phantom.
Figure 4B:
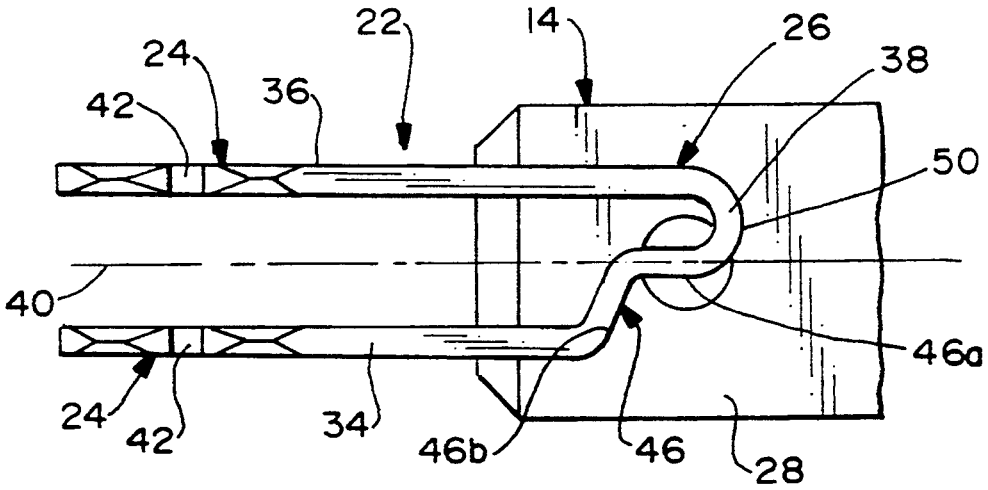
FIG. 4B is a top plan view of the connector assembly and mating connector of FIG. 3 with the housings of each connector removed to show the mating terminal engagement.

Referring now to FIGS. 4A and 4B in conjunction with FIGS. 2 and 3, blade-receiving terminal 22 is generally U-shaped and is stamped and formed of sheet metal material as will be described further in relation to FIG. 6. The generally U-shaped configuration of the terminal is defined by a pair of leg portions 34 and 36 joined to a bight portion 38. The leg portions define a longitudinal terminal axis 40 (FIG. 4B) generally centrally therebetween. The free ends of the leg portions define the IDT portion 24 of the terminal and are provided with insulation displacement means in the form of parallel insulation displacing slots 42 which extend generally perpendicular to terminal axis 40. Therefore, insulated electrical wire 12 is terminated to terminal 22 by forcing the wire into slots 42 in the direction of arrow "A" (FIG. 2). The two parallel slots provide redundant electrical contact between the center conductor of the insulated electrical wire and the blade-receiving terminal by way of two points of contact on each IDT slot, for a total of four points of contact. The slots further provide a redundant mechanical connection as well, by increasing the resistance to wire pull-out with the provision of two slots.

Figures 5A, 5B:
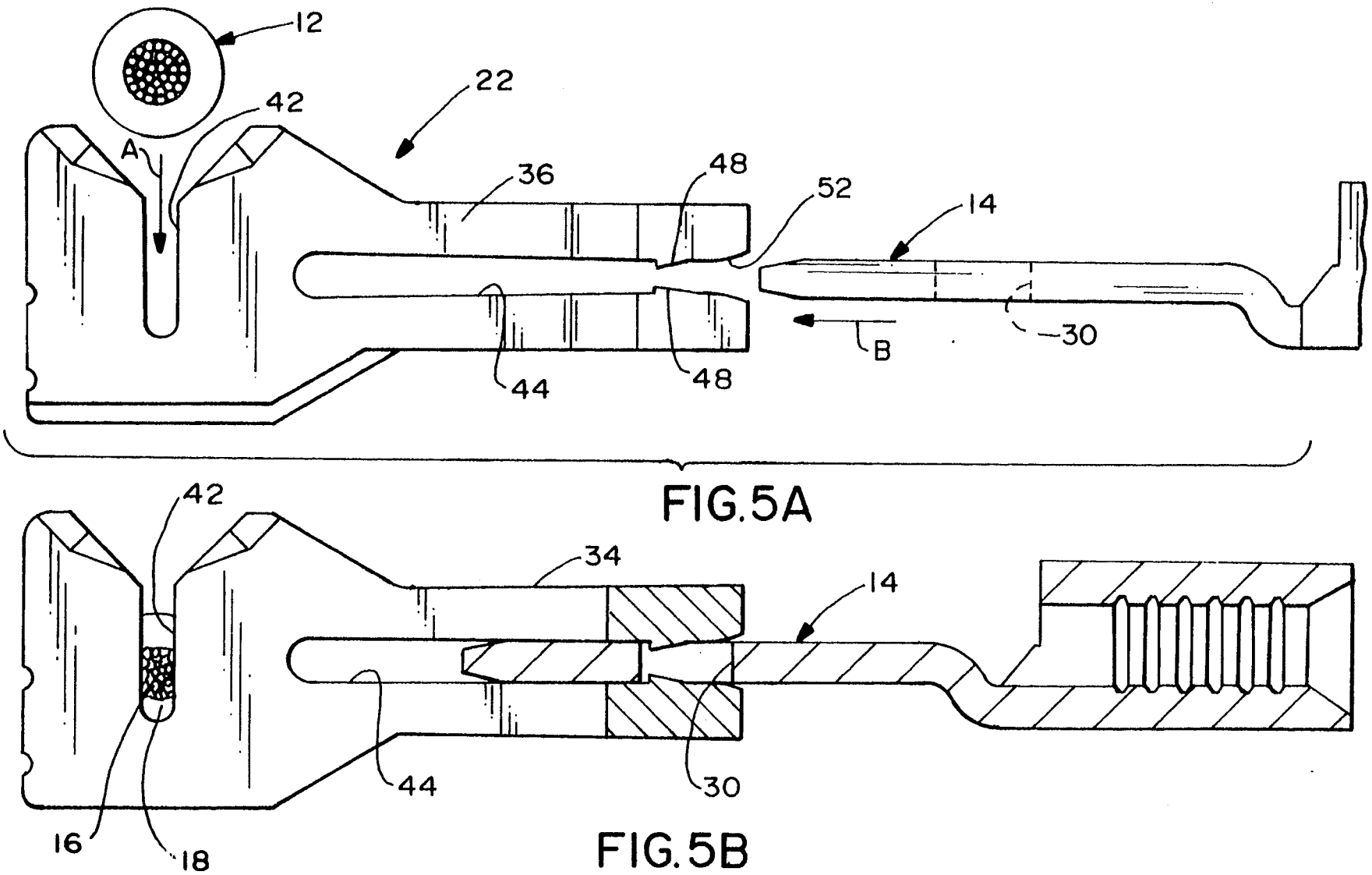
FIG. 5A is a side elevational view of the blade-receiving terminal shown in FIG. 2–4, shown with a blade contact prior to mating.
FIG. 5B is a side sectional view taken generally along lines 5B—5B of FIG. 3 showing the blade-receiving terminal in mating engagement with both a blade contact and an insulated wire, with the housings removed to facilitate understanding of the component interengagement.

Referring now to FIGS. 5A and 5B in conjunction with FIGS. 2–4, bight portion 38 of terminal 22 includes a blade-receiving slot 44 extending into leg portions 34 and 36. The slot defines a bifurcated contact formation for receiving blade portion 28 of blade contact 14 inserted into the slot in the direction of arrow "B". Generally, the invention is directed to a unique configuration of terminal 22 for facilitating locking engagement with locking recess 30 of blade contact 14.

More particularly, bight portion 38 is indented on one side thereof, as best seen in FIG. 4B, to define an offset portion, generally designated 46, which is offset inwardly of leg portion 34. In essence, offset portion 46 is defined by a longitudinal section **46*a* which is located generally along the longitudinal terminal axis 40, and an oblique section 46*b* which joins longitudinal section 40*a* with leg portion 34. Blade-receiving slot 44 extends through offset portion 46 into leg portions 34 and 36. As seen in FIGS. 5A and 5B, a pair of locking projections 48, one on either side of slot 44, extend into the slot at offset portion 46 along longitudinal section 46*a*, and are adapted for lockingly engaging locking aperture 30 of blade contact 14 when the blade contact is adequately positioned in mating condition with the slot. The locking projections are therefore located substantially along longitudinal terminal axis 40**.

As best seen in FIG. 4B, by providing offset portion 46, bight portion 38 defines an apex 50 of terminal 22 which is located on a side of terminal axis 40 opposite the offset portion. As best seen in FIGS. 2 and 5A, an area 52 of slot 44 at or proximate apex 50 is enlarged to provide a lead-in mouth for facilitating insertion of blade contact 14 thereinto.

From the foregoing, it can be understood that by providing offset portion 46, locking projections 48 can be located generally along longitudinal terminal axis 40. With locking aperture 30 being located along centerline 32 of blade contact 14, the blade contact can be inserted into the terminal symmetrical therewith and provide considerable contact surface area between the edges of the bifurcated contact formation provided by slot 44 and the planar sides of the blade contact surrounding locking aperture 30. In addition, bight portion 38 is maintained and can be enlarged at area 52 to provide a lead-in mouth for the blade contact, as discussed above. It should be noted that slot 44 is tapered slightly along the leg portions toward the apex of the terminal, as seen most clearly in FIG. 5A. This taper allows the electrical interface between the terminal and the blade contact to be maximized, i.e. to extend along substantially the entire slot, thus maximizing the current-carrying capacity of the terminal. This is shown most clearly in FIGS. 5B wherein the blade contact is shown in mating engagement with the blade-receiving terminal, and the blade-receiving slot 44 no longer exhibits a taper but is opened by the blade contact and exhibits a substantially uniform slot.

Figure 6:
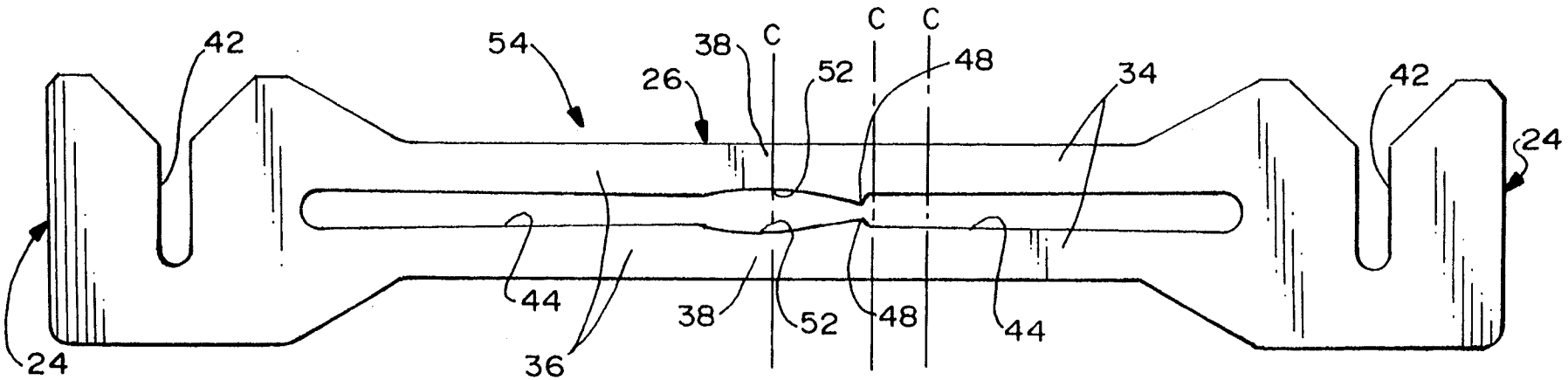
FIG. 6 is a plan view of a metal stamped blank formation from which the blade-receiving terminal is formed.

Lastly, FIG. 6 shows a flat blank of sheet metal material, generally designated 54, which is subsequently formed into the U-shaped blade-receiving terminal configuration of FIGS. 2–5. All of the above-described components of the blade-receiving terminal are shown in FIG. 6 including the areas of the blank which form leg portions 34 and 36, bight portion 38, enlarged free ends of the leg portions defining the IDT portion 24 including insulation-displacing slots 42, locking projections 48, blade-receiving slot 44 including the taper, and enlarged area 52 of the bight portion defining the lead-in mouth. The blank is formed or folded, approximately along areas designated "C", to yield the generally U-shaped terminal of FIGS. 2–5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a connector assembly for connecting an insulated electrical wire to a blade contact having generally parallel opposite sides and a generally centrally located locking recess, the connector assembly including a generally U-shaped, stamped and formed sheet metal terminal including a pair of leg portions joined to a bight portion, the leg portions defining a longitudinal terminal axis generally centrally therebetween and having free ends with insulation displacement slots for electrically connecting the terminal to the insulated wire, the bight portion including a slot extending into the leg portions and defining a bifurcated contact formation for receiving the blade contact, wherein the improvement in said terminal comprises:

said bight portion being indented on one side of the longitudinal terminal axis to define an offset portion inwardly of one of the leg portions, said slot and bifurcated contact formation extending into the offset portion, and a locking projection inside the slot at the offset portion for lockingly engaging the locking recess of the blade contact.

2. In the connector assembly of claim 1, including two locking projections at the offset portion of the terminal, one on each side of the slot for engagement in locking recesses on both opposite sides of the blade contact.

3. In the connector assembly of claim 1, wherein said terminal locking projection is located generally along the longitudinal terminal axis.

4. In the connector assembly of claim 1, wherein said bight portion of said terminal includes an apex of the terminal on a side of the longitudinal terminal axis opposite the offset portion.

5. In the connector assembly of claim 4, wherein an area of said slot in the bight portion of the terminal proximate said apex is enlarged to provide a lead-in mouth for facilitating insertion of the blade contact thereinto.

6. In the connector assembly of claim 1, wherein said slot is tapered toward the bight portion so that the slot is generally uniform when a blade contact is inserted thereinto.

7. In a generally U-shaped terminal for connecting an insulated wire to a blade contact with a recess formed therein, said terminal including two generally parallel leg portions and a bight portion, the leg portions defining a longitudinal terminal axis generally centrally therebetween, each leg portion including an insulation displacement end defining an IDT slot adapted to make an electrical connection to the insulated wire, and a blade-connecting end spaced from the insulation displacement end, and defining a blade-receiving slot generally perpendicular to the IDT slot, the blade-receiving slot extending along substantially the entire length of the blade-connecting end, and the blade-connecting end including the bight portion connecting ends of the two leg portions and having said slot extending continuously through said bight portion into the ends of the two leg portions, the improvement in the terminal comprising:

the bight portion being indented on one side of the longitudinal terminal axis to define an offset portion; and means for locking to the blade contact located in the slot of the bight portion at the offset portion and generally along the longitudinal terminal axis.

8. The terminal as set forth in claim 7, wherein said bight portion includes an apex of the terminal on a side of the longitudinal terminal axis opposite said offset portion.

9. The terminal as set forth in claim 8 wherein the means for locking to the blade contact comprises a projection formed on the offset portion and extending into the inside blade-receiving slot, and adapted to extend into the recess of the blade contact upon mating engagement of the blade contact to the terminal.

10. The terminal as set forth in claim 9 wherein the projection formed on the offset portion is spaced from the apex of the bight portion toward the insulation displacement end of the terminal.

11. The terminal as set forth in claim 9 wherein the offset portion of the bight portion of the terminal further comprises a longitudinal section located generally along the longitudinal terminal axis, and an oblique section joining the longitudinal section to one of the leg portions.

12. The terminal as set forth in claim 11 wherein the projection is located within the longitudinal section of the offset portion of the bight portion.

13. In the electrical terminal of claim 8, wherein an area of said blade-receiving slot proximate said apex is enlarged to provide a lead-in mouth for facilitating insertion of the blade contact thereinto.

* * * * *